United States Patent [19]

Abbate

[11] Patent Number: 4,850,063

[45] Date of Patent: Jul. 25, 1989

[54] WATER CLOSET FASTENER

[76] Inventor: Daniel Abbate, 74 Dayton Rd., Lake Worth, Fla. 33467

[21] Appl. No.: 193,053

[22] Filed: May 12, 1988

[51] Int. Cl.[4] ..... E03D 11/16

[52] U.S. Cl. ..... 4/252 R; 285/60; 411/970

[58] Field of Search ..... 4/252 R, 420, DIG. 7; 285/56, 57, 58, 59, 60; 411/84, 85, 107, 112, 386, 533, 970

[56] References Cited

U.S. PATENT DOCUMENTS

| | | | |
|---|---|---|---|
| 939,001 | 11/1909 | Forster | 285/59 |
| 2,239,797 | 4/1941 | Tinnerman | 411/970 |
| 2,704,680 | 3/1955 | Bedford, Jr. | 411/119 X |
| 2,772,560 | 12/1956 | Neptune | 411/970 X |
| 3,148,379 | 9/1964 | Müller | 4/420 |
| 3,181,585 | 5/1965 | Brewington | 285/60 X |
| 3,339,215 | 9/1967 | Flood | 4/252 R |
| 3,419,298 | 12/1968 | Worley | 4/252 R |
| 3,456,706 | 11/1969 | Ollis, Jr. | 411/84 |
| 3,775,780 | 12/1973 | McEwan | 4/420 X |
| 4,729,707 | 3/1988 | Takahashi | 411/386 X |

*Primary Examiner*—Henry J. Recla
*Assistant Examiner*—Daniel D. Stein-Freer
*Attorney, Agent, or Firm*—Alvin S. Blum

[57] ABSTRACT

A bolt for fastening a water closet to a floor flange has a shoulder portion for engaging the arcuate slot of the flange to prevent rotation of the bolt during installation and removal. A spring bias device on the shoulder maintains the vertical orientation of the bolt during installation and prevents the bolt from falling through the flooring.

9 Claims, 4 Drawing Sheets

23
20
20
19
19
24
11
8
12
24
6
7
4
2
17
14
15
16
25

WATER CLOSET FASTENER

BACKGROUND OF THE INVENTION

This invention relates to fastenings for attaching vitreous toilet bowls to the conventional plumbing coupling and bathroom floor and more particularly to a bolt structure that facilitates the positioning of the bowl and the installation and removal of the fastening means.

A ceramic water closet or toilet bowl is ordinarily connected to the sewer outlet pipe by means of an intermediate flanged coupling inserted through a hole in the bathroom floor. The coupling is secured to the flooring and connected to the sewer pipe. The flange of the coupling has an outer diameter greater than that of the hole in the flooring and has screw holes for screwing the flange securely to the flooring. The flange is also provided with two or more arcuate slots, having one enlarged end adapted to receive the head of a bolt. The bolts, generally referred to as closet bolts, are provided with a head of generally oval configuration of a dimension permitting insertion of the head through the enlarged end of the slot. The bolt is then slipped into the narrow portion of the slot where the head engages the underside of the slot and thereby secures the bolt to the flange. A wax sealing ring seals the outlet of the water closet to the sewer line.

The ceramic toilet bowl or water closet is provided with bolt-receiving holes in its base so that the threaded shafts of the closet bolts inserted in the slots will project upward through the base of the water closet. Suitable washers and nuts are then engaged with the bolts and tightened to hold the bowl firmly in place against the flooring. That portion of the threaded shaft of the bolt extending above the nut is cut or broken off and the nut is covered by a decorative ceramic cover. In certain situations the hole in the flooring may extend beneath the slot, and the bolt head, which is expected to rest upon the flooring to hold the bolt in place while positioning the bowl, instead falls through the flooring. The oval configuration of the head is for the purpose of positioning the greatest dimension of the oval transverse to the slot for greater holding strength. However, during turning of the nut on the shaft, the bolt head may be rotated to a less useful orientation. Ocassionally, when tightening the nut, the bolt rotates freely in the slot, especially if some of the threads are damaged, making it difficult to tighten the nuts. Occasionally, when attempting to position the bowl correctly over the bolts, the bolts are displaced from their vertical position. Whenever the bowl has been lowered into place and then must be lifted off again to correct a bolt position, the wax ring must be replaced. Another more common problem relates to removal of the nuts from the bolts. The nuts may be frozen to the bolts by corrosion, or cutting the excess shaft may have damaged the threads so that the nut does not unscrew freely from the bolt, necessitating cutting off the nut in very confined quarters.

Lassa, U.S. Pat. No. 2,436,070 puts a plate beneath the slot to prevent the bolt from falling through. Barber, U.S. Pat. No. 4,227,722 bolts the flange from above the bowl base. Pepper, U.S. Pat. No. 3,846,851 teaches a flange with slot edges that grip the shaft of the bolt. DeAngelis, U.S. Pat. No. 3,905,052 teaches nuts above and below the slot for securing the shaft. Flood, U.S. Pat. No. 3,339,215 teaches a captive washer to prevent the bolt from falling thru. Sakow, U.S. Pat. No. 4,530,629 teaches a resilient washer for bending into the flange to prevent drop-through and rotation and to maintain bolt upright and a partially cut-through shaft for snapping off excess. Forster, U.S. Pat. No. 939,001 teaches a shoulder on the bolt engaging the upper surface of the flange to prevent the bolt falling through the floor. Kundel, U.S. Pat. No. 753,588 teaches a lock washer. And Bedford, U.S. Pat. No. 2,704,680 teaches a bolt for a blind hole that includes a spring element on a shoulder.

SUMMARY OF THE INVENTION

It is accordingly an object of the invention to provide a closet bolt that will always maintain the bolt head in the correct orientation in the slot. It is a further object to provide a bolt that is not free to rotate when it is inserted into the narrow portion of the slot to facilitate screwing a nut on or off the threaded shaft. It is yet another object to provide a closet bolt with means to maintain its upright position after being struck by the bowl during installation.

The closet bolt of the instant invention has: a generally oval head; an intermediate portion above said head for engaging the sides of the narrow portion of the slot to prevent rotation; a spring means connected to the upper end of said intermediate portion for engaging the upper surface of said flange, thereby biasing said bolt in a vertical position; and a threaded shaft portion extending upwardly from said intermediate portion.

These and other objects, advantages and details of the invention will be best understood by reference to the detailed description and the accompanying drawings appended hereto.

DETAILED DESCRIPTION OF PREFERRED EMBODIMENTS

Figure 1:
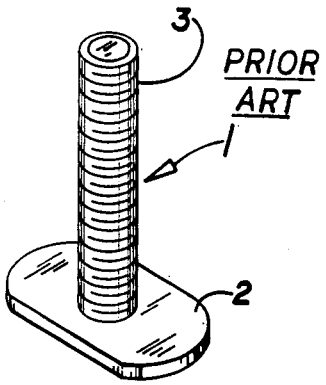
FIG. 1 is a perspective view of a closet bolt of the prior art.
Figure 2:
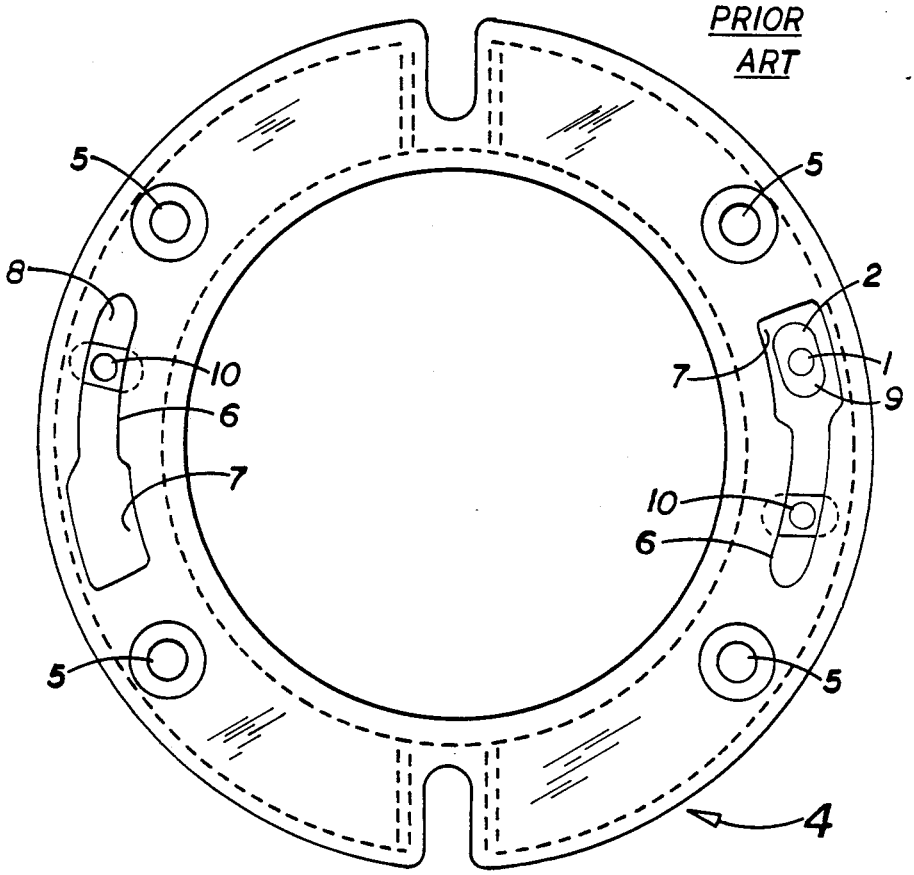
FIG. 2 is a plan view of a floor flange with closet bolts of the prior art in place.

Referring now first to FIG. 1, a conventional closet bolt 1 of the prior art is shown. It has an oval head 2 with a flat underside without a slot, and a threaded shaft 3. FIG. 2 shows a hold down ring or floor flange 4 of the type generally employed for firmly fastening a water closet to the floor and to a soil pipe. A series of screw holes 5 receive screws or bolts that screw into the flooring to securely anchor ring 4 to the flooring. Two or more arcuate slots 6 are cut in the flange. Each slot has an expanded portion 7 and a narrow portion 8. The expanded portion 7 permits the head 2 of a closet bolt 1 to pass through when the long axis of the oval head is aligned with the long axis of the slot as shown at bolt 9. In ordinary usage, the bolt is then rotated 90° and advanced into the narrow portion 8 of the slot as shown at bolts 10 which are diameterally opposed as they would be in preparation for lowering a water closet over the flange, so that the bolts 10 would pass through bolt holes in the base of the water closet. The portions of the heads shown in phantom engage the underside of the flange when washers and nuts are drawn up over the threaded shafts atop the base of the water closet. These portions of the heads take all the stress when forces are applied to the water closet. If the bolt is accidentally rotated in the installation process so that the long axis is aligned with the long axis of the slot, then so little of the head is engaging the underside of the slot that the bolt may pull through and the water closet may move enough to break the wax seal and cause fluid leakage under stresses applied to the water closet.

Figure 3:
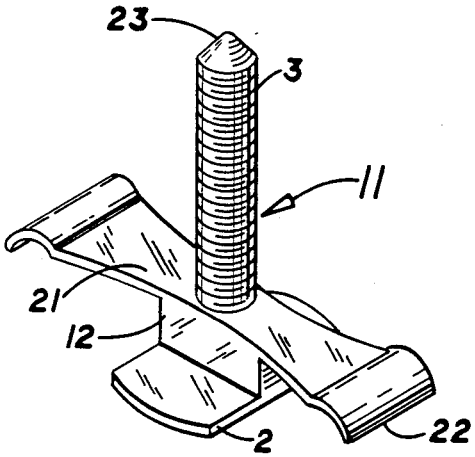
FIG. 3 is a perspective view of a closet bolt of the invention.
Figure 4:
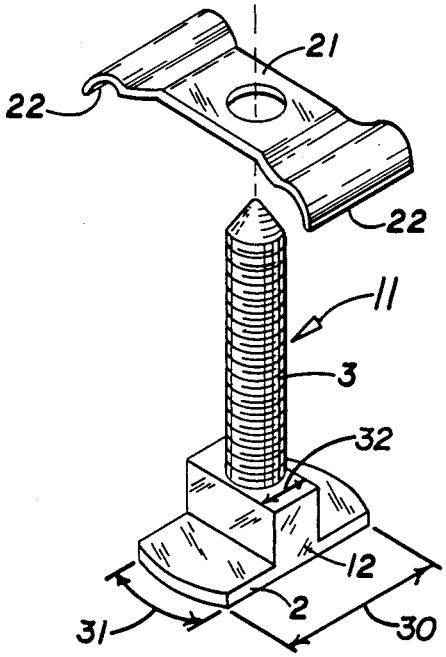
FIG. 4 is a perspective view of another embodiment of the invention.
Figure 7:
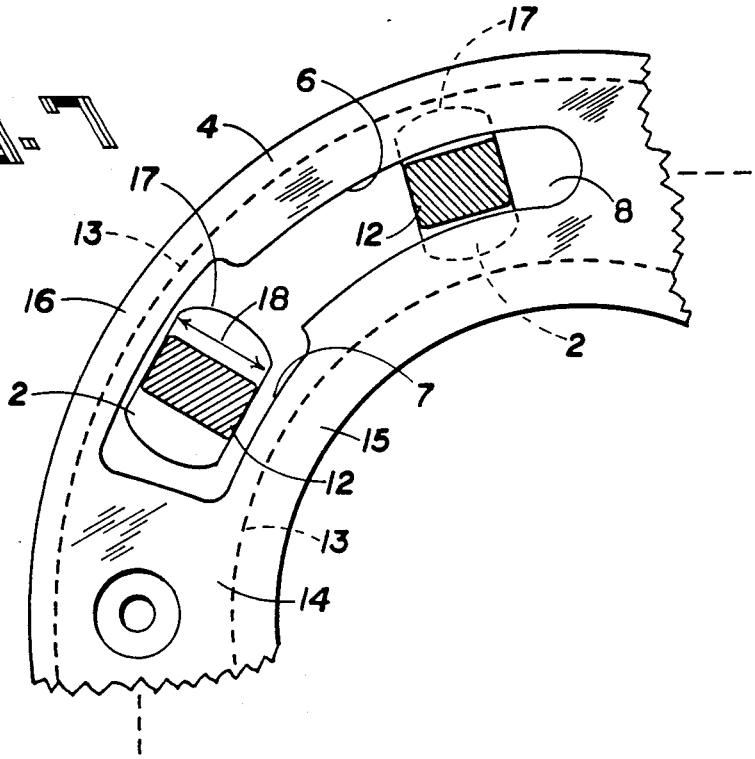
FIG. 7 is a plan view as in FIG. 5 with upper portion of closet bolts cut away.
Figure 8:
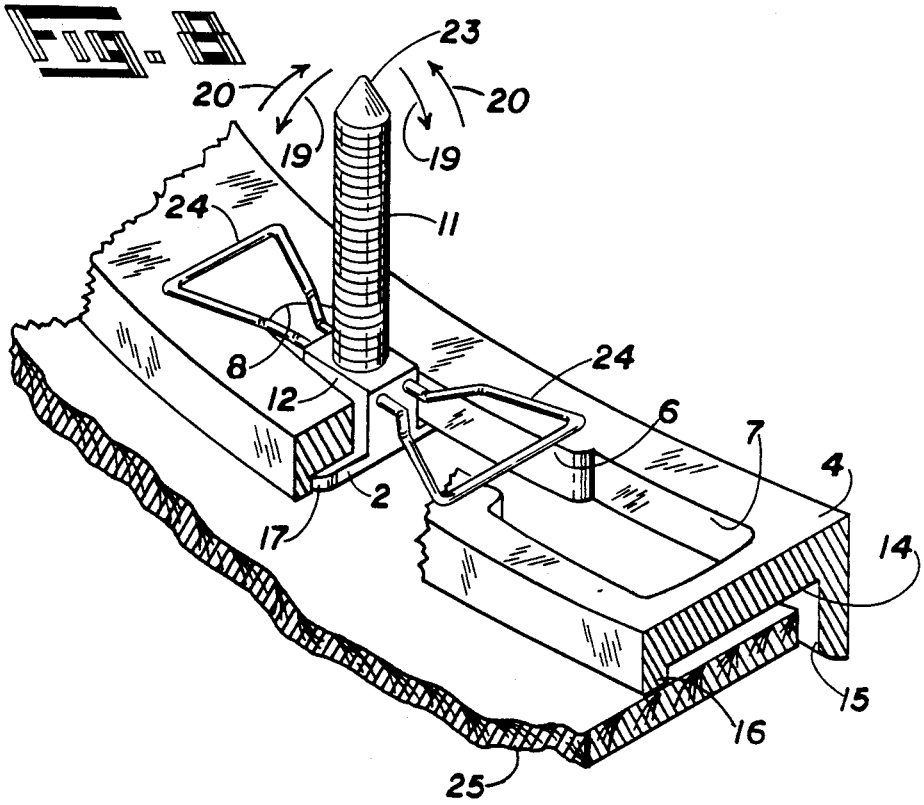
FIG. 8 is a perspective view of a closet bolt in place in a floor flange with portions of flange cut away.

FIG. 3 shows the improved closet bolt 11 with head 2, threaded shaft 3 and shoulder 12 between head and shaft. The function of the shoulder is seen in FIGS. 7 and 8 wherein the shoulder 12 is of dimensions such that it can readily slide into the narrow portion 8 of slot 6 when correctly positioned, but it cannot rotate within the confines of the narrow portion of the slot. Furthermore, the long dimension of the shoulder is greater than the width of the narrow portion of the slot so that it can only be inserted with the long dimension 18 of the shoulder aligned withe the slot as shown in FIG. 7. In this position, the long dimension of the head 2 is oriented transversely to the long axis of the slot, which ensures maximum holding power of the head under stress. The preferred shape and dimension of the head and shoulder are best seen in FIG. 7 wherein the bolts have been cut off at the shoulder. Phantom lines 13 of FIG. 7 indicate the margins of inner ridge 15 and outer ridge 16 on the underside of the flange, defining a groove 14 therebetween, as shown in FIG. 8. The head 2 fits into this groove 14. To maximize the useful head portion, the distance 30 (FIG. 4) between the curved outer edges 17 of head 2 is adjusted so that the head 2 will just fit within the groove 14, when the shoulder 12 is within the narrow portion 8 of the slot 6. The dimension 31 (FIG. 4) of head 2 at right angles to distance 30 is extended as much as possible to provide maximum bearing surface against the flange while still fitting into a particular flange. The extended head is more stable vertically when it rests upon the floor beneath the flange.

The short dimension 32 (FIG. 4) of shoulder 12, orthogonal to the long dimension 18, is made narrow enough to fit within the narrow portion 8 of slot 6 and permit sliding to correct position. The long dimension 18 of the shoulder 12 must be short enough to permit 90° rotation of the bolt after it is inserted into the wide portion 7 of slot 6 so that it can then be advanced into the narrow portion 8 of the slot. And the dimensions of the shoulder must furthermore be such that the bolt is prevented from rotating when within the confines of the narrow portion of the slot. In this case, the long dimension 18 of shoulder 12 is so great that the bolt cannot rotate when within the narrow portion 8 of the slot.

Figure 5:
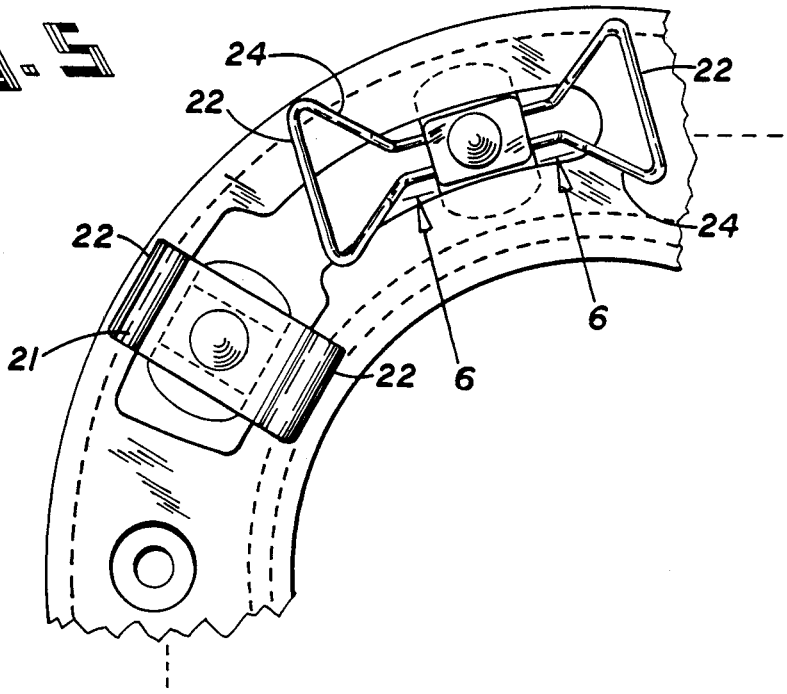
FIG. 5 is a plan view of a portion of a floor flange with two different embodiments of the invention in the slot.
Figure 6:
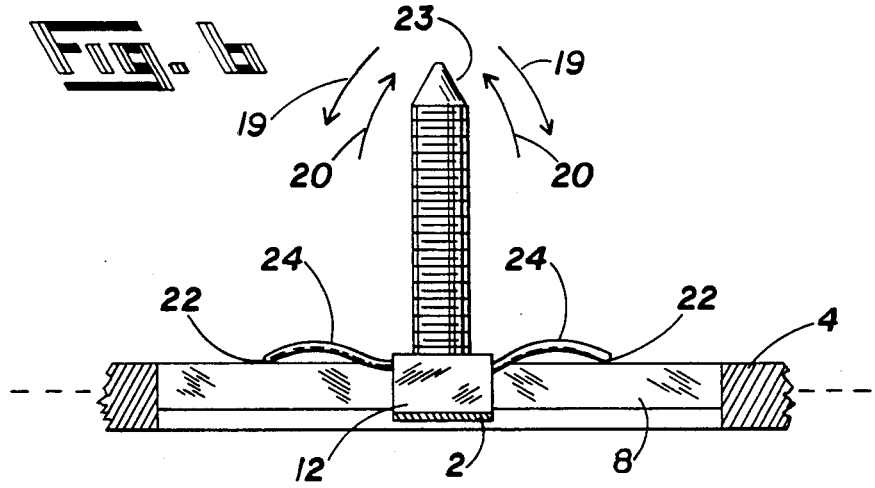
FIG. 6 is a cross sectional view through line 6—6 of FIG. 5.

When the water closet is lifted over the flange 4 and then lowered in an attempt to pass the closet bolts through the holes in the base of the water closet, the bolts are obscured from view by the water closet. The bolts are easily knocked askew if the holes are not correctly aligned. As indicated by the arrows 19 (FIGS. 6 and 8), forces tending to deflect the bolts from their upright position may be exerted inadvertently by the water closet. If the bolts are not vertical, they cannot pass through the holes in the water closet. Holding the water closet over the bolts and maneuvering it correctly is a physically taxing effort. The bolts of the invention provide a spring bias means that exert forces indicated by arrows 20 to counteract deflecting forces 19 so that the bolts will tend to maintain their upright position despite being struck by the water closet. The spring bias means 21 shown in FIGS. 3 and 5 is a strip or leaf extending from the top of shoulder 12 and terminating in a flat portion 22 adapted to engage the top surface of the flange. The spring 21, head 2, shoulder 12 and shaft 3 may be formed in one piece or in separate pieces joined together. By forming a conical top 23 at the top of threaded shaft 3, centering the hole of the water closet over the bolt 11 is facilitated. In the embodiment illustrated in FIG. 4, the spring 21 is a separate washer-like element that may be secured to bolt 11 by cementing, threading, snap-in means, welding and other means well known in the art.

The spring bias means may take other forms as is well known in the art. It is shown in the form of a bent wire spring 24 in FIGS. 5, 6 and 8. The spring bias means serves an additional function. Ordinarily, as shown in FIG. 8, when a hole is cut in flooring 25, there is florring underneath the head 2 of bolt 11 to prevent the bolt 11 from falling through the flooring. However, it sometimes happens that the hole cut in the flooring is irregular, and flooring may be missing beneath the head 2 of bolt 11. The spring bias means provided will prevent the bolt from falling through the flooring in those situations in addition to the other functions it serves.

In an alternative embodiment the entire assembly is molded of a thermoplastic material such as a glass-filled acetal resin, greatly reducing labor costs. Furthermore, the excess shaft may be more easily removed by cutting or melting.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A bolt means for securing a water closet to a floor flange, said flange including a horizontally disposed annular ring, said annular ring including at least one arcuate slot, said arcuate slot including an enlarged portion coextensive with a narrow portion, said annular ring including a pair of concentric ridges on its underside disposed on the sides of said slot, said ridges defining an annular channel on the lower surface of said ring, said water closet adapted for mounting above said ring and provided with at least one bolt hole in its base, said bolt hole adapted to register with said slots and to receive a bolt means secured to said ring, said bolt means comprising:

(a) a vertically extending threaded shaft having a diameter less than the width of said narrow portion of said slot and a length great enough to extend above the bolt hole of said water closet when said water closet is mounted above said ring and said bolt means is secured to said ring and within said bolt hole;

(b) a shoulder means fixedly connected to the lower end of said shaft, said shoulder means provided with a non-round shape to prevent its rotation within said narrow portion of said slot, said shape including a first dimension transverse to the axis of said shaft that is slightly smaller than the width of said narrow portion and a second dimension substantially orthogonal to said first dimension and also transverse tot he axis of said shaft that is greater than the width of said narrow portion;

(c) a head means fixedly connected to the lower end of said shoulder means, said head means having an axial height slightly less than the depth of said channel and a first dimension paralleling and extending beyond said first dimension of said shoulder means close to said ridges to enable said head to slide within said channel and to provide a maximum head portion beneath the edges of said narrow portion of said slot to secure said water closet against stresses and a second dimension substantially orthogonal to said first dimension extending said head along the length of said slot to maximize bearing surface while having dimensions small enough to pass through said enlarged portion of said slot; and, (d) spring bias means connected to the upper portion of said shoulder means and extending laterally therefrom in opposite directions, orthogonal to the direction of said first dimension, said spring bias means having end portions of sufficient width for springably engaging the upper surface of said ring when said bolt is in said narrow portion of said slot to maintain the vertical position of said shaft and to prevent said bolt means from falling through said ring.

2. The bolt means according to claim 1 in which said spring bias means includes bent spring wires.

3. The bolt means according to claim 2 in which said shaft includes a tapered upper portion to facilitate positioning of said water closet.

4. The bolt means according to claim 1 in which said spring bias means includes shaped strips of springy material.

5. The bolt means according to claim 4 constructed of a single molded plastic part.

6. The bolt means according to claim 4 in which said spring bias means is a separate element that includes a central receiving hole for receiving said shaft and securing means for securing said spring bias means in position above said shoulder means.

7. The bolt means according to claim 4 in which said shaft includes a tapered upper portion to facilitate positioning of said water closet.

8. The bolt means according to claim 7 constructed of a single molded plastic part.

9. The bolt means according to claim 1 in which said shaft includes an upper end portion that is tapered to facilitate positioning of said water closet.

* * * * *